US010005198B2

(12) United States Patent
Smithwick, Jr.

(10) Patent No.: US 10,005,198 B2
(45) Date of Patent: Jun. 26, 2018

(54) ROTARY CUTTING DIE HAVING INSERTS FOR SUPPORTING PRODUCT EJECTORS

(71) Applicant: Container Graphics Corporation, Cary, NC (US)

(72) Inventor: James M. Smithwick, Jr., New Bern, NC (US)

(73) Assignee: Container Graphics Corporation, Cary, NC (US)

( * ) Notice: Subject to any disclaimer, the term of this patent is extended or adjusted under 35 U.S.C. 154(b) by 0 days. days.

(21) Appl. No.: 14/813,384

(22) Filed: Jul. 30, 2015

(65) Prior Publication Data

US 2017/0028580 A1 Feb. 2, 2017

(51) Int. Cl.

| | |
|---|---|
| ***B26D 7/18*** | (2006.01) |
| ***B26F 1/38*** | (2006.01) |
| ***B26F 1/44*** | (2006.01) |

(52) U.S. Cl.

CPC ..... *B26F 1/384* (2013.01); *B26D 7/1818* (2013.01); *B26F 1/44* (2013.01)

(58) Field of Classification Search

CPC ..... B26F 1/384; B26F 1/44; B26D 7/1818
USPC ..... 83/139, 128, 113, 116
See application file for complete search history.

(56) References Cited

U.S. PATENT DOCUMENTS

| | | | | |
|---|---|---|---|---|
| 3,277,756 | A | 10/1966 | Des Jardins et al. | |
| 5,546,839 | A * | 8/1996 | Gardiner | B26D 5/12 83/123 |
| 6,477,930 | B1 * | 11/2002 | Sandford | B26D 7/1818 83/162 |
| 6,644,153 | B1 * | 11/2003 | Gordon | B26D 7/1818 493/342 |
| 6,925,918 | B1 | 8/2005 | Bunge | |
| 6,966,245 | B1 * | 11/2005 | Simpson | B26D 7/1818 83/27 |
| 6,997,363 | B1 * | 2/2006 | Vossen | B26D 7/1818 225/103 |
| 7,111,534 | B1 * | 9/2006 | Simpson | B26D 7/1818 83/117 |
| 2006/0112803 | A1 | 6/2006 | Vossen | |
| 2010/0037741 | A1 | 2/2010 | Luquette | |

* cited by examiner

*Primary Examiner* — Omar Flores Sanchez
(74) *Attorney, Agent, or Firm* — Coats & Bennett, PLLC

(57) ABSTRACT

A rotary cutting die apparatus for die cutting corrugated board. The apparatus comprises a die board having one or more opening formed therein. Inserts are seated and secured in the openings. Product ejectors for ejecting die cut product are adhered or otherwise secured to the inserts that are in turn secured within the openings in the die board.

13 Claims, 5 Drawing Sheets

ROTARY CUTTING DIE HAVING INSERTS FOR SUPPORTING PRODUCT EJECTORS

FIELD OF THE INVENTION

The present invention relates to rotary cutting dies specifically designed to cut and score corrugated board that is used in making corrugated board boxes.

BACKGROUND OF THE INVENTION

Rotary cutting dies are used to cut and score sheets of corrugated board to produce a die cut product that can be manipulated into boxes. Rotary cutting dies typically include a curved die board that is configured to mount on a die cylinder. When used, the die cylinder and die board are mounted adjacent an anvil and a nip is defined between the cylinder and the anvil. Sheets of corrugated board are fed into and through the nip and, in the process, the sheet of corrugated board is cut and scored to form the die cut product. Die boards commonly include product and scrap cutting blades, scoring rules, trim and scrap strippers and product ejectors for separating the die cut product from the cutting die.

A common problem with rotary cutting dies that operate on corrugated board is that of controlling the pressure exerted against the corrugated board by the product ejectors. If the pressure is too great, the die cut product is damaged. That is, if the pressure is too great, the flutes are crushed. This makes the resulting boxes weaker and hence the boxes possess less stacking strength and the crushed flutes have a negative impact on the appearance of the product.

On the other hand, if the pressure exerted by the product ejectors is too low, then this will impact the separation of the die cut product from the cutting die during the die cutting operation. That is, if the pressure is insufficient to dislodge or remove the cut die product from the cutting die, it follows that the product will continue with the cutting die and the die cutting operation will be seriously impacted.

There have been attempts at controlling the pressure exerted by the product ejectors. For example, there have been attempts at using softer elastomer ejectors. This has met with only limited success. Even so, the softer elastomer product ejectors can be expensive and that alone has discouraged the adoption of some softer product ejector elastomers. Another attempt at solving this problem has been to use a water jet cutter to cut openings in the product ejectors. This has not proven completely successful. There are still problems with the pressure being too great and resulting in damage to the die cut product. In addition, the use of laser cut product ejectors adds significant cost to cutting dies.

There has been and continues to be a need for a rotary cutting die for cutting corrugated board that provides product ejectors that can exert sufficient pressure against the die cut product to separate the same from the cutting die but yet not so much pressure as to damage or crush the flutes of the die cut product.

SUMMARY OF THE INVENTION

The rotary cutting die includes a curved die board that includes one or more product ejectors are disposed in one or more openings formed in the die board and project out past an outer surface of the die board. To secure the product ejector in the opening, an insert is provided. The insert is secured or seated within the opening in the die board and the product ejector is in turn secured to the insert. The insert can be seated or secured in the opening of the die board such that the product ejector is supported adjacent an inner surface of the die board. This enables the product ejector to assume a significant height or length. The longer the product ejector is below the outer surface of the die board, the lower its compressed pressure will be.

In one embodiment, the rotary cutting die includes a curved die board having one or more openings that are designed to receive one or more product ejectors. Each opening extends completely through the die board, that is from an inner surface to an outer surface. An insert for supporting the product ejector is secured in the opening. The insert includes a bottom and a surrounding wall. The surrounding wall is glued or otherwise secured to the opening in the die board. One end of the product ejector is glued or secured to the bottom of the insert. In this embodiment, the bottom of the insert is disposed adjacent or relatively close to the inner surface of the die board.

In another embodiment, the insert is secured to a recessed area formed around the opening on the inner surface of the die board. Thus, in this embodiment, the insert includes an ejector support that extends across the opening where the outer surface of the insert generally aligns or closely aligns with the inner surface of the die board. Here an end portion of the product ejector is glued or otherwise secured to the ejector support that extends across the opening in the die board.

Other objects and advantages of the present invention will become apparent and obvious from a study of the following description and the accompanying drawings which are merely illustrative of such invention.

DESCRIPTION OF EXEMPLARY EMBODIMENTS

With further reference to the drawings, a rotary cutting die apparatus is shown therein and indicated generally by the numeral 30. As is appreciated by those skilled in the art, the rotary cutting die apparatus 30 is designed to receive sheets of corrugated board CB and to die cut the sheets of corrugated board to produce a die cut product. Further, the rotary cutting die apparatus 30 is designed to cut, score and, in most cases, remove scrap from areas of the product board. In the end, the rotary cutting die apparatus is designed to cut and condition the corrugated board CB such that when the corrugated board exists the rotary cutting die apparatus, the die cut product can be easily manipulated into a box configuration.

Figure 1:
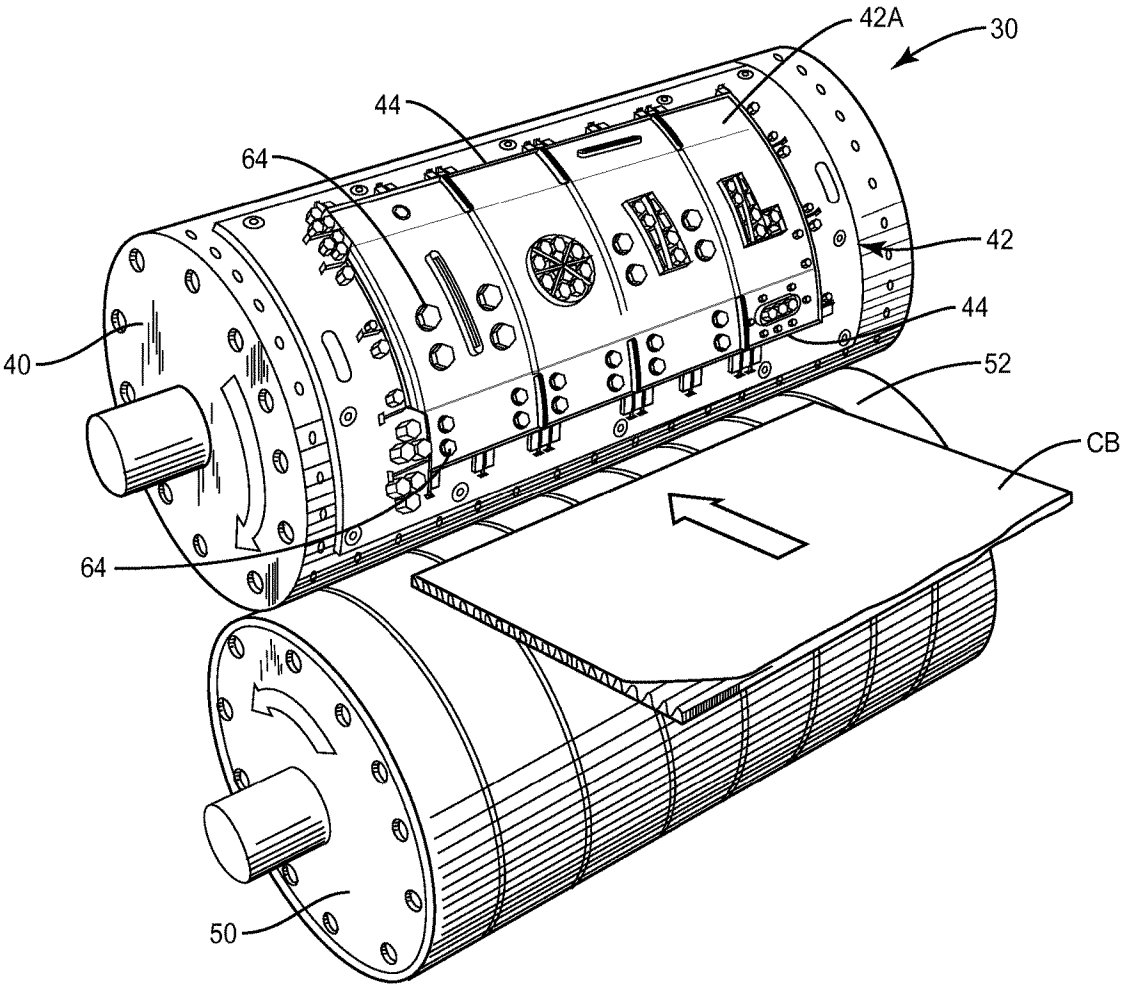
FIG. 1 is a perspective view of a rotary die cutting machine including a rotary cutting die mounted on a die cylinder and an anvil disposed adjacent the die cylinder.

With particular reference to FIG. 1, the rotary cutting die apparatus 30 includes a die board cylinder 40 and an anvil cylinder 50. As will be appreciated from subsequent portions of the disclosure, the die board cylinder 40 is designed to receive and hold a curved die board 42. The die board cylinder 40 and the die board 42 are disposed with respect to the anvil cylinder 50 such that the nip is defined between the cylinder 50 and the anvil. As sheets of corrugated board CB are fed through the nip, the corrugated board is engaged by the die board 42 which trims, cuts and scores the corrugated board. Anvil cylinder 50 is typically surrounded by a sheath 52 which is a relatively durable material such as urethane, which provides a backing surface against which a cut can be made without damaging various components carried by the die board 42. As such, the anvil cylinder 50 rotates in a manner that is generally synchronous with the adjacent die board cylinder 40 during normal operations.

Die board 42 is typically constructed of laminated plywood. Die boards, such as that illustrated in FIGS. 1 and 2, typically include a combination of cutting blades, scoring rules, resilient scrap strippers and product ejectors.

Figure 2:
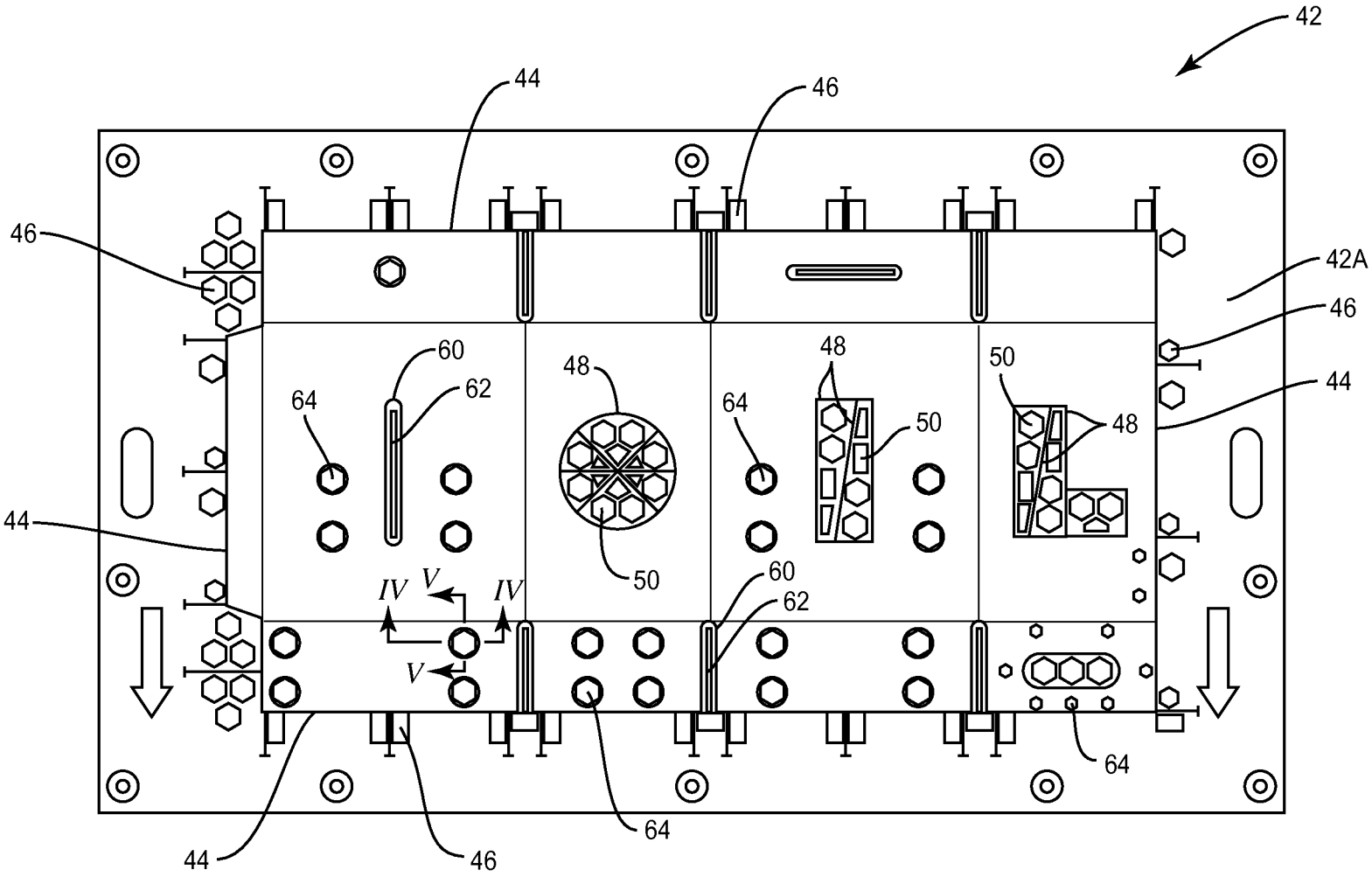
FIG. 2 is a plan view of the rotary cutting die including the die board.

With reference to FIG. 2, a typical die board 42 is shown therein. Die board 42, as noted above, is curved to fit the die cylinder 40. Die board 42 includes an outer surface 42A that is exposed, as viewed in FIG. 1, and an inner surface 42B which lies adjacent and in contact with the die cylinder 40.

In the exemplary die board 42 shown in FIG. 2, the die board has mounted thereto a series of trim cutting blades 44. As seen in FIG. 2, the trim cutting blades 44 extend around the die board 42. Trim blades 44 function to cut the overall dimensions of a die cut product which, as noted above, can be manipulated to form a box. Thus, as seen in FIG. 1, a sheet of corrugated board CB is fed into the nip and as the corrugated board moves through the nip, the trim blades 44 will cut and form the die cut product.

Associated with the trim blades 44 is a series of trim strippers 46. Trim strippers 46 are secured to the die board adjacent trim blades 44 and function to strip trim from the trim blades as the cut product emerges from the nip.

Also, a typical die board, such as that shown in FIG. 2, includes scrap cutting blades and strippers to strip scrap from the scrap cutting blades. For example, scrap cutting blades can be used to cut holes, slots and openings in the die cut product. Therefore, it is appreciated that the scrap cutting blades and scrap strippers are typically disposed within the confines of the trim blades 44. In the exemplary die board 42 shown in FIG. 2, there is a series of scrap cutting blades indicated by the numeral 48. Note, for example, the circular trim blade 48 disposed in the second intermediate section of the die board 42 from the left side. Disposed closely adjacent the scrap blades 48 is a series of scrap ejectors 50. In the case of the circular scrap blade discussed above, it is seen that there is an array of resilient and compressible scrap strippers 50 disposed within the confines of the circular scrap blade 48. To the right of the circular scrap blade 48 there are other scrap blades that are laid out to cut rectangles or L-shaped scrap pieces from the corrugated board. The scrap blades also have scrap ejectors 50 associated therewith. Note also in FIG. 2 where scrap blades are utilized to cut slot in the corrugated board. In the example illustrated, there is a series of scrap blades 60 that conform to an elongated slot for cutting a slot in the corrugated board. Disposed interiorly of the scrap blades 60 are scrap strippers 62 for ejecting scrap from the die cut product as it exits the nip. It is appreciated that the scrap strippers are positioned on the die board 42 to align with the piece of scrap being cut by the adjacent scrap blades. Again, as the corrugated board passes through the nip of the rotary die cutting apparatus 30, the scrap strippers will be compressed between the cut scrap pieces and the corrugated board and when the cut die product exits the nip, the scrap strippers will expand and in the process will extend to engage the cut pieces of scrap and strip the scrap from the adjacent scrap cutting blade or blades.

The die board 42 is provided with means to eject the cut die product. In other words, the die board is provided with means that function to separate the die cut product from the cutting die or die board 42. These are referred to as product ejectors and are referred to in the drawings by the numeral 64. Product ejectors are strategically placed on the die board to efficiently separate the die cut product from the die board 42. In FIG. 2 there are numerous product ejectors 64 disposed transversely across a leading portion of the die board. There is also product ejectors 64 disposed transversely across intermediate portions of the die board 42. And there may be some product ejectors 64 disposed adjacent the trailing end portion of the die board 42.

The product ejectors 64 are constructed of resilient and compressible material and are designed to be compressed as the die cut product passes through the nip. As the die cut product exits the nip, the product ejectors 64 expand or extend to engage the die cut product and effectively push the die cut product from the various blades and generally from the die board.

In the embodiments illustrated herein, the product ejectors 64 are not secured directly to the die board 42. Rather, the die board is conditioned or machined to receive inserts that are designed to receive and support the product ejectors 64. That is, the product ejectors 64 are secured to the inserts which are in turn secured to the die board 42.

With reference to FIGS. 3-6, the die board 42 is provided with one or more openings 42C. Each opening, as will be discussed herein, is designed to accept an insert. In the exemplary design shown and discussed herein, the opening 42C is a bore or round opening that is formed in the die board 42. In some embodiments, the opening 42C may not be required to extend completely through the die board 42. However, in the embodiments illustrated herein, the opening 42C does extend completely through the thickness of the die board 42. That is, the opening 42C extends from the outer surface 42A to the inner surface 42B. See FIGS. 3-5.

Figure 3:
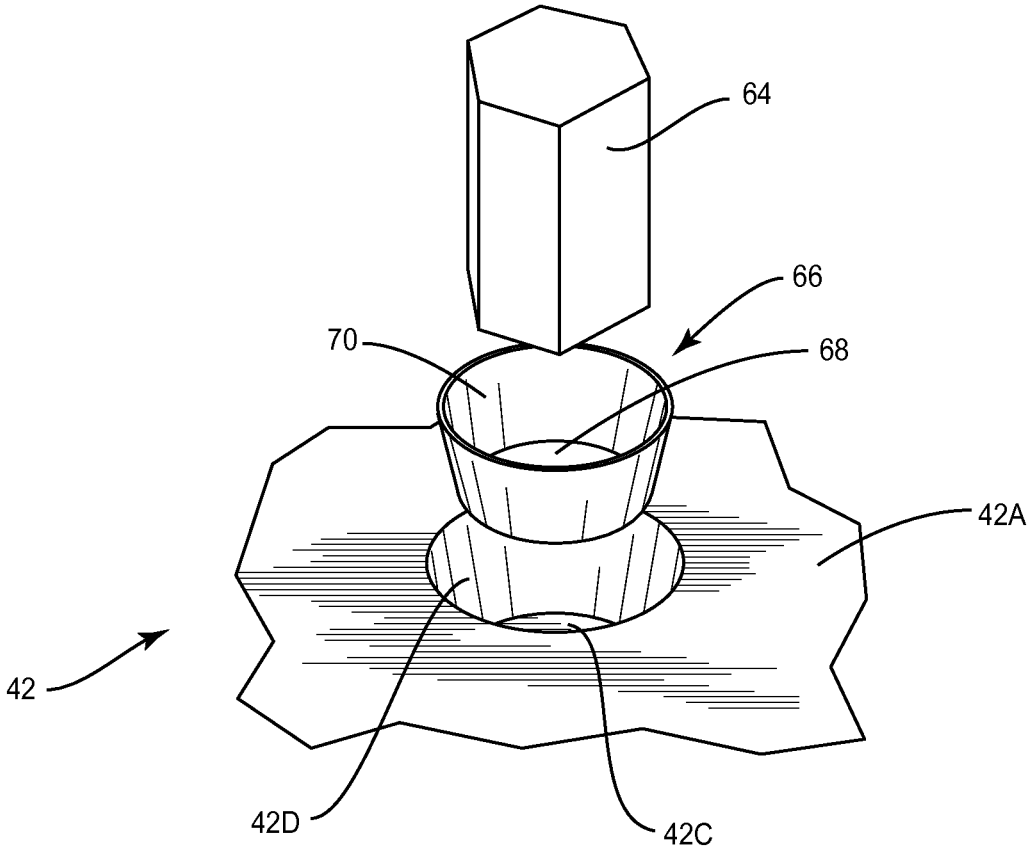
FIG. 3 is an exploded fragmentary perspective view showing the die board, insert that is designed to be secured in the die board and a product ejector that is secured to and supported by the insert.
Figure 4:
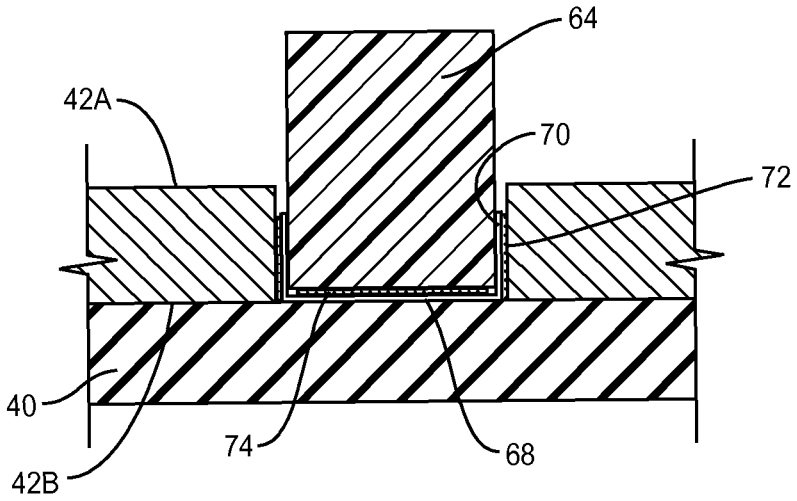
FIG. 4 is a sectional view taken through the line IV-IV of FIG. 2.
Figure 5:
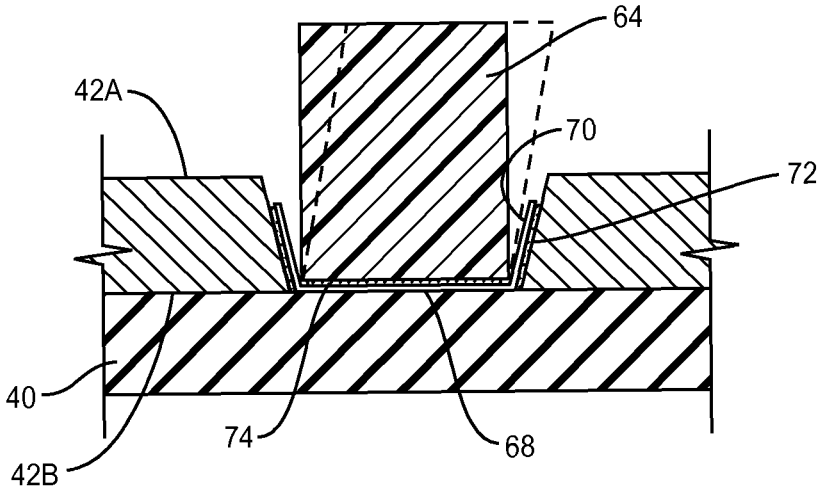
FIG. 5 is a sectional view taken through the line V-V of FIG. 2.

FIGS. 3-5 show one embodiment of an insert. This insert is referred to generally by the numeral 66. It assumes a cup shape and can be constructed of plastic, metal or any suitable material. In this embodiment, the insert 66 includes a bottom 68 that also functions as a product ejector support. Extending upwardly from the bottom 68 is a surrounding wall structure 70.

In this embodiment, the insert 66 is seated in the die board 42 such that the bottom lies in a plane that generally aligns with the inner surface 42B of the die board 42. This is shown in FIGS. 4 and 5. The surrounding wall 70 may be disposed at various angles with respect to the bottom 68. Since the die board 42 is curved, it follows that the wall structure 42D of the openings 42C may tend to flare when viewed in the direction of rotation of the die board 42. Note FIG. 5, which is a sectional view taken through the line V-V in FIG. 2. This shows the opposite sides of the wall structure 42D of the opening 42C being slightly flared outwardly. Thus, the wall structure 70 of the insert 66 can be flared a corresponding amount so as to conform to the shape of the wall structure 42D of the opening 42C. In the other direction, illustrated by FIG. 4, which is a section taken through the line IV-IV in FIG. 2, it is seen that the wall 70 of the insert can be generally perpendicular to the bottom 68. In any event, it should be pointed out that the angle of the wall structure 70 of insert 66 can be perpendicular all the way around the insert or can be flared at an angle all the way around the insert or can be a combination of the two.

The insert 66 is securely anchored in the opening 42C. Various ways can be utilized to secure the insert 66 into the opening 42C. In the exemplary embodiments shown herein, the insert 66 is glued into the opening 42C. Thus, there is a first adhesive layer 72 that is interposed between the exterior side of the wall structure 70 of the insert 66 and the wall structure 42D of the opening 42C. The adhesive layer is continuous around the insert 66 or can be placed in spots or areas. This will secure the insert 66 in the opening 42C. The insert 66 may be press fitted into the opening 42C.

The product ejector 64 can assume various shapes. Generally, it can be elongated and can have a cylindrical surface or, as the embodiment shown in the drawings suggest, the product ejector can be multi-sided. To secure the product ejector 64 in the insert 66, an end portion of the product ejector is glued to the bottom or ejector support 68 of the insert 66. Thus, as seen in FIGS. 4 and 5, there is a second adhesive layer 74 interposed between an end portion of the product ejector 64 and the bottom 68 of the insert. Thus, the product ejector 64 is secured to the insert 66 while the insert is secured to the opening 42C of the die board 42.

Figure 6:
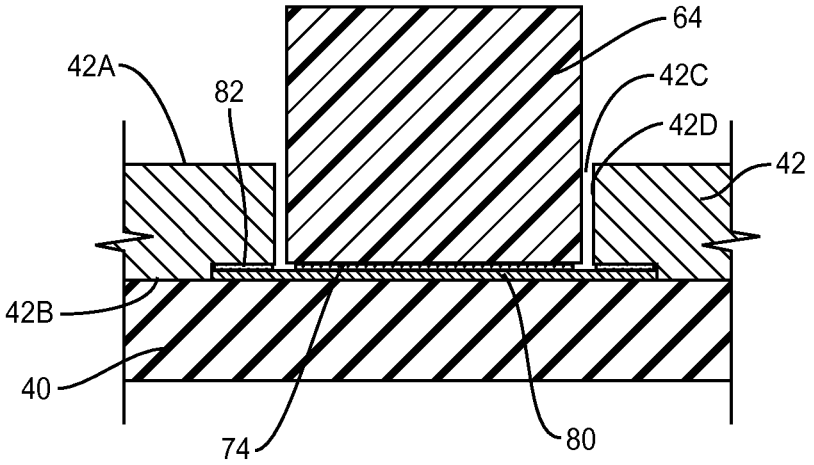
FIG. 6 is a fragmentary sectional view of an alternate design for the insert.

FIG. 6 shows an alternate embodiment for securing the product ejector 64 to an insert. In this case, an insert 80 is secured about the inner surface 42B of the die board 42 but in a position where the insert spans the opening 42C in the die board. In this case, a small recess is formed in the inner surface 42B of the die board 42 around the opening 42C. The insert 80 is secured to the recessed area. This is shown in FIG. 6. In the embodiment illustrated herein, there is a layer of adhesive 82 disposed between the recessed area and the insert 80, securing the insert to the die board 42. The insert 80, like the insert 66 in FIGS. 3-5, can be constructed of various suitable materials such as plastic, metal, etc. In the example shown in FIG. 6, it may include a relatively thin piece of plastic or metal that spans the overlying opening 42C. Insert 80 may be slightly curved to conform to the curvature of the inner surface 42B of the die board. Again, to secure the product ejector 64 to the insert 80, there is provided an adhesive layer 74 between the end of the product ejector 64 and the insert 80. This will securely anchor the product ejector 64 in the opening 42C in the die board 42.

There are numerous advantages to securing the product ejector 64 in the manner described herein. First, the inserts enable a secure connection to be made directly to the insert and indirectly to the die board 42. In addition, controlling the pressure exerted by the product ejector 64 is facilitated by being able to utilize relatively long product ejectors. By employing inserts in the die board 42 and providing the ejector support of these inserts relatively close to the inner surface of the die board enables the product ejectors to assume relatively long lengths. Typically the die board 42 is approximately one-half inch. By employing the inserts described herein, the product ejector 64 can extend approximately ⅝" above the outer surface 42A of the die board 42. This enables a cutting die manufacturer to selectively choose and use ejector material that will permit pressure to be controlled and will enable the product ejectors to efficiently eject die cut product without crushing and damaging the same.

The present invention may, of course, be carried out in other ways than those specifically set forth herein without departing from essential characteristics of the invention. The present embodiments are to be considered in all respects as illustrative and not restrictive, and all changes coming within the meaning and equivalency range of the appended claims are intended to be embraced therein.

What is claimed is:

1. A rotary cutting die adapted to be mounted on a rotary die cylinder for cutting corrugated board fed into a nip disposed between the cylinder and a rotating anvil to produce a die cut product, the rotary cutting die comprising:

a curved die board configured to be mounted to the die cylinder;

one or more cutting blades mounted on the die board for cutting the corrugated board fed through the nip to produce the die cut product;

one or more openings formed in the die board with each opening having a wall;

one or more inserts configured to be received and held in the one or more openings in the die board;

each insert including a bottom and a wall structure;

each insert secured in one of the openings in the die board;

one or more product ejectors seated and secured in the one or more inserts for engaging a portion of the die cut product passing through the nip and assisting in separating the die cut product from the cutting die;

each product ejector comprising compressible material and in a no-load condition an outer portion of the product ejector lies outwardly of the insert; and wherein the die board includes outer and inner surfaces and wherein the insert has a height that is less than or approximately equal to the distance between the outer and inner surfaces.

2. The rotary cutting die of claim 1 wherein each opening formed in the die board extends completely through the die board; wherein there is an adhesive layer lying between at least a portion of the wall structure of the insert and at least a portion of the wall of the opening in the die board for securing the insert to the die board; and wherein there is a second adhesive layer lying between the bottom of the insert and an end portion of the product ejector for securing the ejector to the insert.

3. The rotary cutting die of claim 1 wherein the wall structure of the insert is curved or multi-sided.

4. The rotary cutting die of claim 1 wherein the wall structure of the insert includes a surrounding wall structure where at least a portion of the surrounding wall structure is flared outwardly.

5. The rotary cutting die of claim 1 wherein the insert is constructed of a plastic material.

6. The rotary cutting die of claim 1 wherein the wall structure of the insert includes a surrounding wall structure and wherein portions of the surrounding wall structure viewed in the direction of rotation of the die board are generally parallel and wherein portions of the surrounding wall structure forming leading and trailing edges of the insert are flared generally outwardly.

7. The rotary cutting die of claim 1 wherein the wall structure insert is generally parallel.

8. The rotary cutting die of claim 1 wherein the insert is press fitted into the opening in the die board.

9. A rotary cutting die adapted to be mounted on a rotary die cylinder for cutting corrugated board fed into a nip disposed between the cylinder and a rotating anvil to produce a die cut product, the rotary cutting die comprising:

a curved die board configured to be mounted to the die cylinder and having an inner surface and an outer surface;

one or more cutting blades mounted on the die board for cutting the sheet of corrugated board and forming the die cut product;

one or more openings formed in the die board with each opening extending from the outer surface to the inner surface of the die board;

one or more inserts inserted and secured into the die board with each insert having an ejector support that extends across the opening and disposed adjacent the inner surface of the die board while being spaced from the outer surface of the die board;

a product ejector disposed in the opening in the die board and projecting outwardly therefrom for engaging the die cut product passing through the nip and assisting in separating the die cut product from the cutting die;

the product ejector secured to the ejector support of the insert and extending therefrom through the opening in the die board towards and past the outer surface of the die board; and wherein the insert has a height that is less than or approximately equal to the distance between the outer and inner surfaces.

10. The rotary cutting die of claim 9 wherein the insert is in the form of a cup having a bottom that forms the ejector support.

11. The rotary cutting die of claim 9 including a first adhesive layer for securing the insert to the die board and a second adhesive layer for securing an end portion of the product ejector to the ejector support of the insert.

12. The rotary cutting die of claim 9 wherein the insert includes the ejector support and a surrounding wall structure extending from the ejector support towards an outer surface of the die board and wherein the ejector support and surrounding wall structure form a holding device for receiving and holding the product ejector; a first adhesive layer secured to a wall structure of the opening and secured to the surrounding wall structure of the insert for securing the insert to the die board, and a second adhesive layer disposed between an end portion of the product ejector and the ejector support for securing the product ejector to the insert.

13. A rotary cutting die adapted to be mounted on a rotary die cylinder for cutting corrugated board fed into a nip disposed between the cylinder and a rotating anvil to produce a die cut product, the rotary cutting die comprising:

a curved die board configured to be mounted to the die cylinder;

one or more cutting blades mounted on the die board for cutting the corrugated board fed through the nip to produce the die cut product;

one or more openings formed in the die board with each opening having a wall;

one or more inserts configured to be received and held in the one or more openings in the die board;

each insert including a bottom and a wall structure;

each insert secured in one of the openings in the die board;

one or more product ejectors seated and secured in the one or more inserts for engaging a portion of the die cut product passing through the nip and assisting in separating the die cut product from the cutting die;

each product ejector comprising compressible material and in a no-load condition an outer portion of the product ejector lies outwardly of the insert; and wherein the wall structure of the insert includes a surrounding wall structure and wherein portions of the surrounding wall structure viewed in the direction of rotation of the die board are generally parallel and wherein portions of the surrounding wall structure forming leading and trailing edges of the insert are flared generally outwardly.

* * * * *